United States Patent [19]

Murray

[11] Patent Number: 4,526,819

[45] Date of Patent: Jul. 2, 1985

[54] CHRISTMAS TREE DECORATION

[76] Inventor: Robert W. Murray, 969 Esquimalt Ave., West Vancouver, B.C., Canada, V7T 1J9

[21] Appl. No.: 502,012

[22] Filed: Jun. 7, 1983

[51] Int. Cl.[3] ..... A47G 33/08

[52] U.S. Cl. ..... 428/7; 428/10; 428/19

[58] Field of Search ..... 428/8–12, 428/18–20; D11/118; 362/122, 123; 242/54 R

[56] References Cited

U.S. PATENT DOCUMENTS

| | | | |
|---|---|---|---|
| 720,367 | 2/1903 | Lucas | 428/9 |
| 970,470 | 9/1910 | Culver | 428/16 X |
| 1,764,540 | 6/1930 | Vydra | D11/118 X |
| 1,778,597 | 10/1930 | Herzog | 428/7 X |
| 2,659,993 | 11/1953 | Raymond | 428/7 |
| 3,676,275 | 7/1972 | Sloane | 428/9 |
| 3,677,867 | 7/1972 | Westlund | 428/9 |
| 3,905,140 | 9/1975 | Damiano | 428/19 X |
| 3,967,019 | 6/1976 | Magee | 428/19 X |
| 4,399,171 | 8/1983 | Murray et al. | 428/7 |

FOREIGN PATENT DOCUMENTS

| | | | |
|---|---|---|---|
| 804283 | 1/1969 | Canada | 428/7 |

*Primary Examiner*—Henry F. Epstein
*Attorney, Agent, or Firm*—Christie, Parker & Hale

[57] ABSTRACT

A decoration for a tree, in particular a Christmas tree is provided, which comprises a shaft having a lower end adapted to attach to the top of the tree, and one or more garlands attached to the shaft and reversibly windable adjacent to it. Preferably, the garlands are attached to respective pulleys mounted about the shaft, such mounting preferably being fixed with respect to the shaft.

15 Claims, 5 Drawing Figures

CHRISTMAS TREE DECORATION

FIELD OF THE INVENTION

This invention relates to a decoration for a tree utilizing a storage device for releasably storing a plurality of garlands.

BACKGROUND OF THE INVENTION

It is a common practice in many households to decorate a Christmas tree with garlands. As well, it is also a common practice to decorate such a tree with a tree top decoration such as an angel or similar decorative element attached to the top of the tree. These two elements having typically in the past each been attached separately to the tree. Typically, an end of each garland to be installed would be attached to an upper end of the tree by hand. For tall trees this would necessitate the use of a ladder which would have to be moved successively around the tree depending upon the number of garlands to be attached. Even in shorter trees, an end of each garland to be attached to the tree must be separately attached to an upper end of the tree. Once an upper end of the garland was attached to the tree, the person installing the same would then have to dismount from the ladder (if one was used) and proceed to walk around the tree while distributing the garland vertically on the tree. Where taller trees are used, in order to obtain a good vertical distribution of the garland, the garland must be pulled somewhat while being wound around the tree. In many cases, this pulling would result in the garland becoming detached from the upper end of the tree since the attachment is typically initially made only by means of frictional attachment or by adhesive tape or the like to avoid damaging the trees' appearance. Also, since the garlands are typically stored in a rolled or folded position, care must be taken to avoid entangling them during their application to the tree.

When the tree decorations are to be removed from the tree, each of the garlands and the tree top decoration must be removed separately. As well, it will also be necessary to roll or fold the garlands for use the following year.

It is desirable therefore to have a decoration for a tree which also acts as a storage unit for a plurality of garlands and allows the garlands to be removed readily from the device and returned back in to it, and further simplifies the above cumbersome and time consuming procedures of applying and removing the tree top decoration and garlands separately.

SUMMARY OF THE INVENTION

The present invention then, provides a decoration for a tree which comprises a shaft having a lower end adapted to attach to the top of the tree, and a garland attached to the shaft and reversibly windable adjacent thereto. Preferably, the garland is reversibly windable around the shaft.

In a preferred construction of the decoration, a storage unit is provided which has a pulley mounted about the shaft, and in which the garland is attached to the pulley. By "attached" to the pulley in reference to the garland is meant that the garland is connected to the pulley in a manner such that it can be reversibly wound about it.

Usefully, a plurality of storage units and garlands are provided in the decoration. In a further preferred embodiment, the pulley or pulleys of each storage unit is fixedly mounted about each shaft, that is so that each pulley cannot rotate with respect to the shaft.

DRAWINGS

One embodiment of the present invention will now be described with reference to the drawings in which.

DESCRIPTION OF THE EMBODIMENTS OF THE INVENTION

Figure 1:
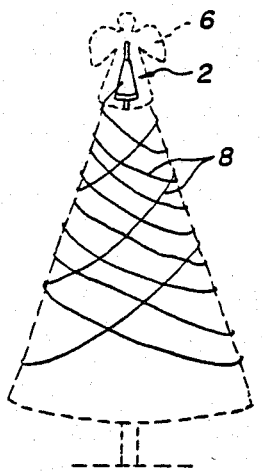
FIG. 1 is a vertical plan view of a decoration for a tree installed on the top of the tree with the garlands extended therefrom.
Figure 3:
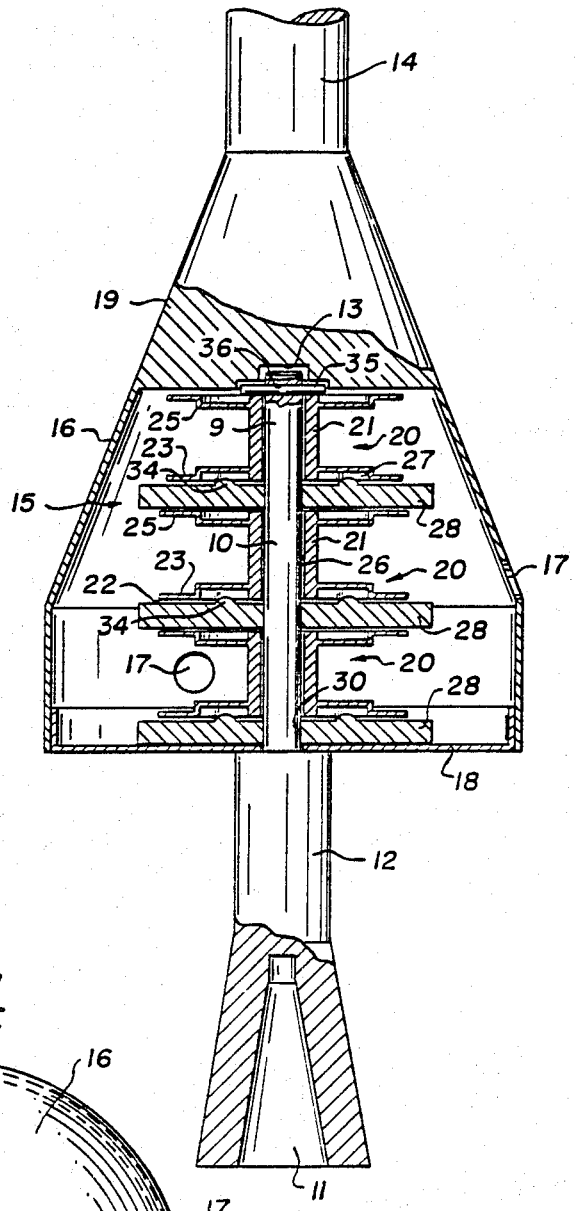
FIG. 3 is a view along the line 3—3 of FIG. 2 with the garlands removed for clarity.
Figure 2:
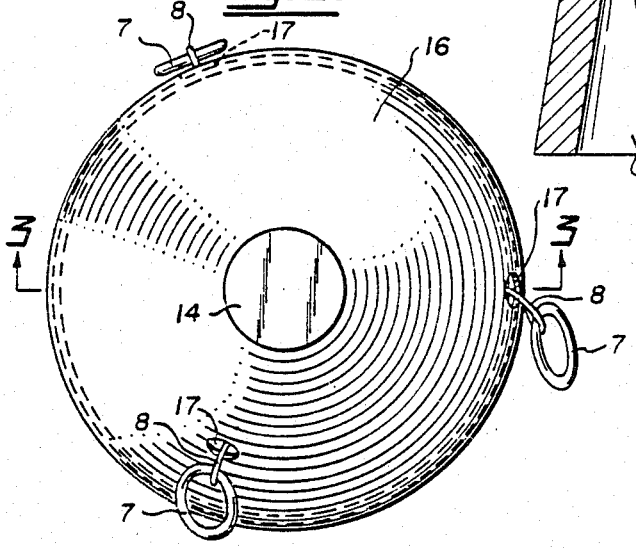
FIG. 2 is a top plan view of the decoration of FIG. 1 with the decorative element removed.
Figure 4:
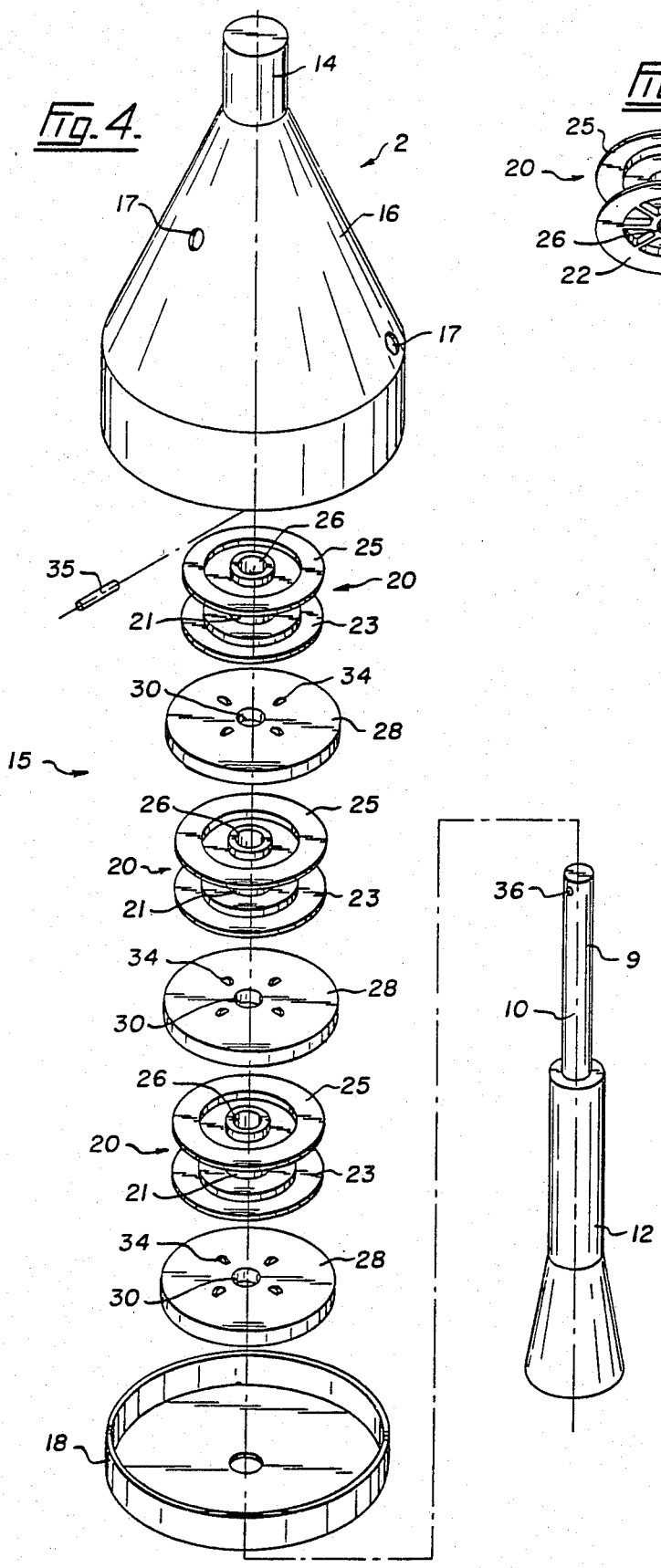
FIG. 4 is an exploded perspective view of the tree decoration of FIG. 1 with the decorative element and the garlands removed.
Figure 5:
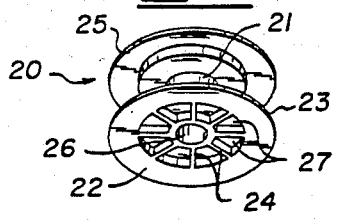
FIG. 5 is a view from below of one of the pulleys of FIG. 1.

The tree decoration 2 of FIGS. 1 to 5 has a shaft 10 with a lower end 12 adapted to attach to the top of a tree by means of a truncated conical bore 11. The truncated conical bore 11 has an aperture for receipt of the top of the tree and is contained in a flared portion of the lower end 12. The lower end 12, where it attaches to an upper end 9 of the shaft 10, is of larger diameter than the upper end 9. The tree decoration has three storage units for garlands, each storage unit having a pulley 20 which is independently rotatably mounted on the upper end 9 of the shaft 10 and a substantially flat circular plate 28 which is fixedly connected to the shaft 10 and extends transversely outward from it adjacent an outside lower end surface 22 of the pulley. The pulley 20 of each storage unit is independently rotatably mounted on the shaft 10 simply by having the bore 26 slightly larger than the diameter of the upper portion 9 of the shaft 10. The plate of each storage unit is fixedly connected to the upper portion 9 of the shaft 10 most conveniently by press fitting upon the upper portion 9 of the shaft 10. In the particular embodiment shown in FIGS. 1 through 5 inclusive, there are three storage units in the tree decoration. The plate 28 of each one of the storage units is arranged adjacent the pulley 20 of the next one of the storage units so that longitudinal movement of the pulleys on the upper end 9 of the shaft 10 is restrained. That is, in the embodiment shown in the drawings, each of the pulleys 20 are restrained from longitudinal movement on the upper end 9 of the shaft 10 by one or more adjacent plates 28, except for the pulley 20 at the upper end of the upper portion 9 of the shaft 10, which is restrained by an elongated pin 35 passing through a hole 36 in the upper end 11 of the shaft 10. A plurality of garlands 8 are attached to a corresponding one of the pulleys 20 by having an end of the garland attached to the barrel 21 of that pulley 20.

The pulley 20 of each of the storage units has a plurality of equally spaced, coplanar spokes 24 projecting an equal distance outwardly and downwardly from the lower end surface 22 of the pulley 20. For structural strength, each of the pulleys 20 also has a circular flange 23 extending around the lower end of the pulley 20 and connected to an outer end of each of the spokes 24. Each of the spokes 24 acts as a grip. Each of the storage units also has a plurality of equally spaced resilient polymer segments 34 attached to an upper end of the plate 28 and projecting an equal distance upwardly from it. These resilient polymer segments 34 are conveniently made of drops of silicone glue which project into the spaces 22 between the spokes 24 a distance of about 1 millimeter. All three of the storage units together with the upper end 9 of the shaft 10 and the pin 35 make up a storage device 15 for releasably storing the three garlands 8.

A housing 16 is provided over and around the upper portion of the shaft 12 and the storage device 15, which housing has a lower end 18 disposed on the upper end 9 of the shaft 10 adjacent the lower end 12 of the shaft 10. A hole is centrally provided in the lower end 18 of the housing 16 which is of a slightly larger diameter than the upper end 9 of the shaft 10. The remainder of the housing 16 is attached to the lower end 18 by means of screws or similar means (not shown). The housing 16 has a solid portion 19 having a circular recess 13 which is slightly larger than the diameter of the upper end 9 of the shaft 10 and acts as a bearing surface for it. The housing 16 also has an upper end 14 which provides a convenient position to which the decorative element 6 of the tree decoration may be attached. The decorative element 6 conveniently extends sufficiently far down as to cover the housing 16 when the tree decoration is installed on the top of a Christmas tree as is shown in FIG. 1. The housing 16 also has three holes 17 distributed around the housing 16, and also vertically spaced so that each is horizontally coplanar with a corresponding one of the pulleys 20. Each of the garlands 8 has an end which extends through the corresponding one of holes 17 and is attached to a ring 7 which is larger in diameter than the hole 17.

The tree decoration can be made of a great variety of materials, and is conveniently made substantially entirely of plastic with the shaft 10 being made of wood, and the pin 35 being made of metal for strength. When the shaft 10 is made of wood, it can be conveniently formed to the required shape by any of a number of known techniques. The lower end 18 of the housing can then be placed in position on the upper end 9 of the shaft 10 adjacent the lower end 12 of the shaft 10. One of the substantially flat circular plates 28 with drops of cured silicone glue as resilient elements 34 previously applied to it, can then be press fitted onto the upper end 9 of the shaft 10 with the resilient elements 34 on the upper side of that circular plate 28. A pulley 20 is then positioned on the upper end 9 of the shaft 10 with its outside lower end surface 22 and adjacent flange 23, adjacent the upper surface of the circular plate 28. Another circular plate 28 with its resilient polymer segments 34 of drops of cured silicone glue previously attached to its upper surface, is then press fitted to the upper end 9 of the shaft 10 with its lower side adjacent the upper end surface 25 of the pulley 20 previously installed. This second circular plate is positioned on the upper end 9 of the shaft 10 at a position so that the resilient polymer segments 34 on the first circular plate 28 previously installed, project into the spaces between the spokes 34 a distance of about 1 millimeter. The remainder of the pulleys 20 and plates 28 can then be positioned on the upper end 9 of the shaft 10 in a similar manner. After the uppermost of the pulleys 20 has been positioned, the pin 35 is inserted through the hole 36 in the upper end 9 of the shaft 10. The remainder of the housing 16 can then be attached to the lower portion 18 of the housing 16, and the decorative element 6 then attached to the upper end 14 of the housing 16.

When it is desired to use the tree decoration, it is installed with the upper end of the tree firmly penetrating the bore 11 of the lower end 12 of the shaft 10. The user then reaches under the decorative element 6 of the tree decoration 2 and pulls one of the rings 7 in order to remove the attached garland 8 from the corresponding storage unit by unwinding from the pulley 20. As the shaft 10 is firmly attached to the top of the tree it is held stationary by it, and as a result of the dimensions of the resilient polymer segments 34, the resilient polymer segments 34 of the storage unit disengage from against the spokes 24 which they tend to normally engage against as described hereafter, in response to the torque applied to the pulley 20 by pulling on the ring 7 of the corresponding garland, so that the pulley 20 can rotate while the shaft 10 is held stationary. Thus, a particular garland 8 can be unwound readily from its corresponding storage unit as the resilient polymer segments 34 of the circular plate 28 of that storage deform to allow the spokes 24 of the pulley 20 to ride smoothly over them with only minor resistance. Thus, each of the garlands 8 can be removed from its corresponding storage unit by pulling on its attached ring 7, it being possible to remove the garlands 8 equal or unequal distances from their corresponding storage units as desired to effect the desired decorative appearance on the tree. When the garlands 8 are being wound around the tree, the upper end of each of the garlands 8 is firmly attached to the tree as a result of being attached to the bore 21 of a pulley 20 of a corresponding storage unit, and as a result of the tree decoration 2 being firmly attached to the upper end of the tree by means of the bore 11 in the lower end 12 of the shaft 10.

When it is desired to remove the above tree decoration from the tree, the lower end 12 of the shaft 10 is simply lifted off the top of the tree and the garlands 8 unwound from the tree. The garlands 8 can then be returned to their corresponding storage units by turning the bottom end 12 of the shaft 10 while holding the housing 16. In this situation which is referred to as the normal situation wherein the shaft 10 is being rotated and the pulley 20 of the corresponding garland is not being held stationary, the resilient polymer segments 34 of the corresponding storage unit will engage against the spokes 24 of the pulley 20 of that storage unit and cause the pulley 20 to rotate when the shaft 10 is rotated. As a result, by rotation of the shaft 10 the garlands 8 are simultaneously wound onto the pulley 20 of their corresponding storage units. If the garlands 8 have not been withdrawn an equal distance from their corresponding storage units, then at least one of the garlands will be completely wound onto the pulley 20 of its corresponding storage unit before the others so that its attached ring 7 is adjacent the hole 17 in the housing 16. When this happens, the pulley 20 of the corresponding storage unit of that garland is in effect held stationary. In such a situation, as a result of the dimensions of the resilient polymer segments 34 and their resilient nature, they will disengage from against the spokes 24 of the pulley 20 in response to the torque applied to the shaft 10 so that the shaft 10 can continue to be rotated while that pulley 20 is held stationary by the ring 7 on the corresponding garland being adjacent the hole 17 in the housing 16. As a result, the shaft 10 can continue to be rotated until each of the garlands 8 is completely wound back onto the pulley 20 of its corresponding storage unit even though they may have initially been withdrawn an unequal distance from their corresponding storage units.

Various modifications to the invention are of course possible. For example, the resilient polymer segments 34 which are mounted on the upper end 9 of the shaft 10 through the circular plate 28 to which they are attached, and which together with the spokes 24 of a pulley 20 of that storage unit acts as a clutch means, could be replaced by other clutch means. Thus, it would be possible to use a pulley with a smooth outer surface and use brake shoes which are urged against such a surface by means of springs or similar means. Alternatively, the resilient polymer segments could be positioned on an outer end surface of the pulley, and ribs disposed on an adjacent plate, the resilient polymer segments normally engaging against the ribs. Also, it would be possible to install a similar type clutch means between the inside of the bore of the pulley and the shaft which clutch means could use resilient means and a grip, or use a frictional grip between the inside bore of the pulley and the shaft by having the bore diameter only slightly larger than the shaft diameter. However, none of these aforementioned constructions provide a storage unit which is as simple to construct as the storage unit described above in the tree decoration. As well, the resilient polymer segments which act as resilient means can each be replaced by other resilient means such as a curved piece of plastic mounted on a plate within guides and urged toward the spokes of a pulley by means of a spring. Again though, such a construction would be more complex than that described above. It is not essential that the lower surface of the plate of one storage unit be adjacent the upper surface of the pulley of the next lower one of the storage units. However, such a configuration helps to restrain longitudinal movement of the pulleys on the shaft and in effect, in conjunction with the pin, provides a simple means by which the pulleys are held in position on the shaft. Other means such as bearings press fitted onto the upper end 9 of the shaft 10, could be used to hold the pulleys in position on the shaft 10, and each of the storage units could be separated by any desired distance. However, again, a more complex and less compact storage device is produced. The resilient polymer segments 34 could also be placed on a lower surface of the plate of each storage unit, with the spokes being disposed on the outside upper end surface of the pulley of that storage unit. Such a configuration though, tends to result in more friction in a simple device constructed without bearings, since this would mean that the pulley of at least some of the storage units would have its weight applied against a plate of an adjacent storage unit. The resilient polymer segments and the spokes could also be unequally spaced. However, with equal spacing the pulley of each storage unit turns more smoothly and with less vibration.

Other modifications to the above described decoration could include providing one or more pulleys as described which are fixedly attached to the shaft. Such a device would still be useful from the point of view of convenient storage of the garlands upon respective pulleys. However, as there is no clutch means present this means that the garlands would have to be wound and unwound from their respective pulleys when the shaft is not attached to the top of the tree, as rotation of the shaft will of course occur with rotation of the pulleys. In addition, such an embodiment suffers from the disadvantage that turning the shaft will not wind garlands of different lengths completely upon their respective pulleys. Of course, each of the pulleys could alternatively be rotatably mounted upon the shaft but in such an embodiment one would have to provide access to the pulleys so that the garlands could be wound upon the pulleys by direct turning of them.

As will be apparent to those skilled in the art in light of the foregoing disclosure, many other alterations and modifications are possible in the practice of this invention without departing from the spirit or scope thereof. Accordingly, the scope of the invention is to be construed in accordance with the substance defined by the following claims.

I claim:

1. A decoration for a tree, comprising:

(a) a shaft having a lower end adapted to attach to the top of the tree; and (b) a garland attached to said shaft and reversibly windable adjacent thereto.

2. A decoration as described in claim 1 wherein said garland is reversibly windable around said shaft.

3. A decoration for a tree comprising:

(a) a shaft having a lower end adapted to attach to the top of the tree;

(b) a storage unit having a pulley mounted about said shaft; and (c) a garland attached to the pulley of said storage unit.

4. A decoration for a tree comprising:

(a) a shaft having a lower end adapted to attach to the top of the tree;

(b) a plurality of storage units each having a pulley mounted about said shaft; and (c) a plurality of garlands each attached to the pulley of a corresponding one of said storage units.

5. A decoration for a tree as described in claim 3 wherein the pulley of said storage unit is fixedly mounted about said shaft.

6. A decoration for a tree as described in claim 4 wherein the pulley of each of said storage units is fixedly mounted about said shaft.

7. A decoration as defined in claim 1 wherein the lower end adapted to attach comprises an aperture for receipt of the top of the tree.

8. A decoration as defined in claim 1 wherein the lower end adapted to attach comprises a bore for receipt of the top of the tree.

9. A decoration as defined in claim 3 wherein the lower end adapted to attach comprises an aperture for receipt of the top of the tree.

10. A decoration as defined in claim 3 wherein the lower end adapted to attach comprises a bore for receipt of the top of the tree.

11. A decoration as defined in claim 4 wherein the lower end adapted to attach comprises an aperture for receipt of the top of the tree.

12. A decoration as defined in claim 4 wherein the lower end adapted to attach comprises a bore for receipt of the top of the tree.

13. A decoration according to claim 1 comprising a housing over at least a portion of the said shaft and into which said garland extends.

14. A decoration according to claim 3 comprising a housing over said storage device into which said garland extends.

15. A decoration according to claim 4 comprising a housing over said storage units into which said plurality of garlands extend.

* * * * *